US006591732B2

(12) United States Patent
Gerber et al.

(10) Patent No.: US 6,591,732 B2
(45) Date of Patent: Jul. 15, 2003

(54) METHOD AND DEVICE FOR COOLING GUN BARRELS OF FIREARMS

(75) Inventors: Michael Gerber, Zurich (CH); Gabriel Schneider, Zurich (CH)

(73) Assignee: Oerlikon Conatraves AG, Zurich (CH)

( * ) Notice: Subject to any disclaimer, the term of this patent is extended or adjusted under 35 U.S.C. 154(b) by 0 days.

(21) Appl. No.: 10/004,356

(22) Filed: Oct. 31, 2001

(65) Prior Publication Data

US 2002/0083823 A1 Jul. 4, 2002

Related U.S. Application Data

(63) Continuation-in-part of application No. 09/352,469, filed on Jul. 14, 1999, now Pat. No. 6,311,602.

(51) Int. Cl.[7] ..... F41A 13/04

(52) U.S. Cl. ..... 89/1.25; 89/1.2; 89/14.01; 89/14.05; 42/90; 42/93; 42/95

(58) Field of Search ..... 42/90, 93, 95; 89/1.2, 1.25, 14.01, 14.05

(56) References Cited

U.S. PATENT DOCUMENTS

| | | | | | |
|---|---|---|---|---|---|
| 2,774,281 | A | | 12/1956 | Hawkins | 89/1 |
| 3,383,984 | A | * | 5/1968 | D'Andrea | 89/1.25 |
| 3,391,602 | A | * | 7/1968 | Brooks | 89/1.25 |
| 3,802,511 | A | * | 4/1974 | Good, Jr. | 169/30 |
| 4,062,266 | A | | 12/1977 | Elmore et al. | 89/7 |
| 4,397,214 | A | * | 8/1983 | Mannhart et al. | 184/29 |
| 4,535,676 | A | | 8/1985 | Politzer et al. | 89/14.1 |
| 4,783,053 | A | * | 11/1988 | Yirmiyahu et al. | 254/104 |
| 4,884,490 | A | | 12/1989 | Hürlemann | 89/14.1 |
| 5,149,907 | A | * | 9/1992 | Thiesen | 89/7 |
| 5,179,022 | A | * | 1/1993 | Sanford et al. | 435/285.3 |
| 5,233,128 | A | * | 8/1993 | Lai | 102/511 |
| 5,841,057 | A | | 11/1998 | Birk | 89/1.25 |

FOREIGN PATENT DOCUMENTS

| | | | |
|---|---|---|---|
| DE | 31 45764 A1 | | 6/1983 |
| DE | 3612100 A | * | 11/1986 |
| EP | 0 313 856 | | 5/1989 |
| FR | 1112677 | * | 3/1956 |
| FR | 2723440 | * | 2/1996 |
| GB | 2110352 | * | 6/1983 |
| GB | 2 222 237 A | | 2/1990 |
| SU | 4835616 | * | 7/1990 |

* cited by examiner

*Primary Examiner*—Michael J. Carone
*Assistant Examiner*—John Richardson
(74) *Attorney, Agent, or Firm*—Townsend and Townsend and Crew LLP; Guy W. Chambers

(57) ABSTRACT

A method and device for cooling a gun barrel wherein coolant is provided to the gun barrel via a nozzle arranged at the downstream end of a pressure feed line arrangement. The coolant is originally conveyed from a reservoir into a pressure cylinder, while the pressure feed line between the pressure cylinder and the nozzle is closed. Thereafter, the coolant in the pressure cylinder is placed under a predefined operating pressure. Prior to firing a round, the pressure feed line is opened, so that the coolant flows to the gun barrel before firing. When firing a shot, the coolant in the gun barrel is compressed to a pressure above the predetermined operating pressure by the firing gases and pushed out of the gun barrel. In the process, the coolant is expanded into a buffer reservoir adjacent to the nozzle and is injected back into the gun barrel after the gas pressure built up has been reduced to the predetermined operating pressure.

10 Claims, 2 Drawing Sheets

METHOD AND DEVICE FOR COOLING GUN BARRELS OF FIREARMS

The present invention is a continuation-in-part to U.S. application Ser. No. 09/352,469, filed Jul. 14, 1999 which issued as U.S. Pat. No. 6,311,602 on Nov. 6, 2001.

FIELD OF THE INVENTION

The invention relates to a method for cooling gun barrels of firearms, wherein a coolant is provided to the gun barrel via at least one feed line and at least one nozzle. The invention further relates to a device for executing the method.

BACKGROUND OF THE INVENTION

A prior cooling device for the gun barrels of firearms is known from German Letters Patent DE-PS 31 45 764, which is particularly suited for automatic firearms and heavy-duty automatic cannons. In connection with such heavy-duty firearms firing highly developed munitions, great wear of the gun barrels is a result of the fact that the surface heat cannot be dissipated with sufficient speed. The heat stress, which occurs in rapid sequence when firing a volley, causes surface tensions and changes in the material. The surface area can be heated up to temperatures where the material is in a plastic deformation phase. In addition, because of the outflowing powder gases, as well as the friction between the shell and the gun barrel, the gun barrel material is worn off.

To extend the service life of the gun barrels, the above mentioned German patent proposes to provide cooling conduits in the area of the end section of the gun barrel adjoining a drum, which are oriented radially outward between the individual cartridge seats and which are connected with a main conduit for coolant supply extending in the drum axis. The cooling conduits are connected with nozzles which extend parallel with respect to the longitudinal direction of the drum, terminating in the front face of the drum and are arranged at the same distance from the longitudinal axis of the drum as the center longitudinal axis of the cartridge seats. Blocking elements for the nozzles are provided in the cooling conduits which, in the case of firing, briefly release the respective nozzles located in the area of the barrel opening. The blocking elements are, for example, slides, which can be displaced by means of control elements sliding along a control cam during the rotating movement of the drum. The coolant reaches the interior wall of the gun barrel directly through the nozzles. In this case the nozzles are only opened for the period of time they slide by the rear of the gun barrel, and coolant is only provided if firing takes place. However, the length of sliding time can be too short in connection with gun barrel systems of higher cyclic rates, or respectively with more intense rhythmic firing, so that not enough coolant reaches the gun barrel and insufficient cooling is provided.

OBJECT AND SUMMARY OF THE INVENTION

The object of the invention is to provide a method and a device to sufficiently cool the gun barrels of weapons systems, especially so that high cyclic firing rates can be achieved.

This object is attained by means of the method and device in accordance with the invention. Here, a coolant is conveyed from a reservoir into a pressure cylinder by drawing up a hydraulic piston, in the course of which the feed line arrangement to the gun barrel is closed. Thereafter, the hydraulic piston is moved in the opposite direction by reversal of the pressure, and the coolant in the pressure cylinder is put under a defined operating pressure. Prior to triggering a volley, the feed line is opened so that the coolant can flow via the feed line through a nozzle to the gun barrel. The coolant is respectively pushed back by the gas pressure created when a shot is fired, and is re-injected into the gun barrel after the gas pressure has been reduced to the operating pressure.

The advantages which can be achieved by means of the invention reside in, among other things, the pre-firing lubrication of the gun barrel, the automatic re-lubrication of the gun barrel and the resulting increased service life of the barrel in connection with higher firing cycles. By using one or several nozzles, it is assured that a sufficiently large amount of coolant is injected into the gun barrel, wherein only little coolant can flow back after each round.

A further advantage can be seen to reside in that during the employment of the proposed cooling device, no mechanically actuated parts are required, with the exception of the piston, so that a high degree of dependability can be achieved.

The invention will be explained in what follows by means of an exemplary embodiment in connection with the drawings.

DETAILED DESCRIPTION OF THE PREFERRED EMBODIMENT

Figure 1:
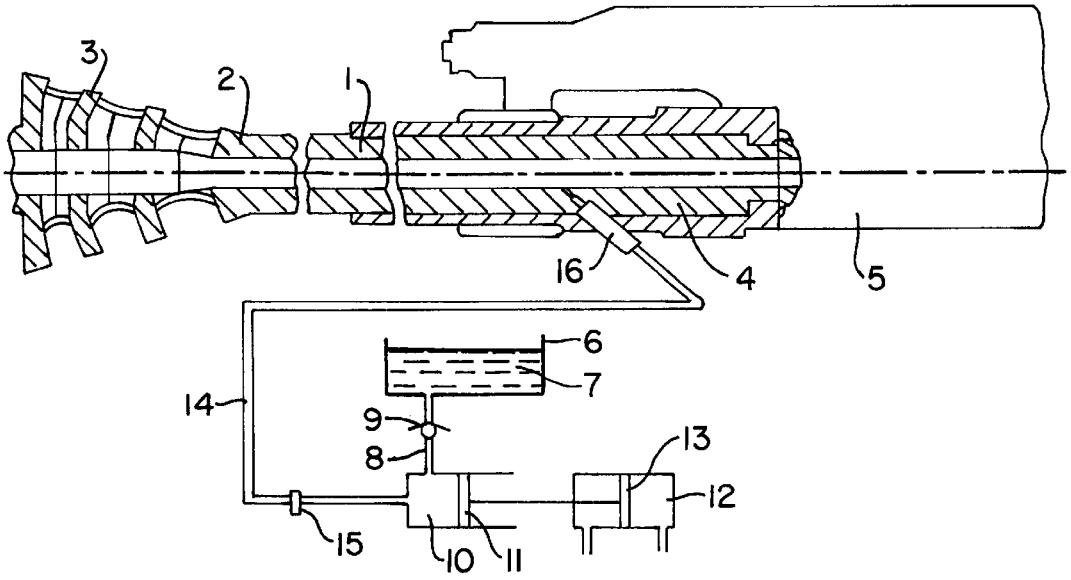
FIG. 1 shows a partial longitudinal section of a cannon with a device in accordance with the invention, in a schematic representation.
Figure 2:
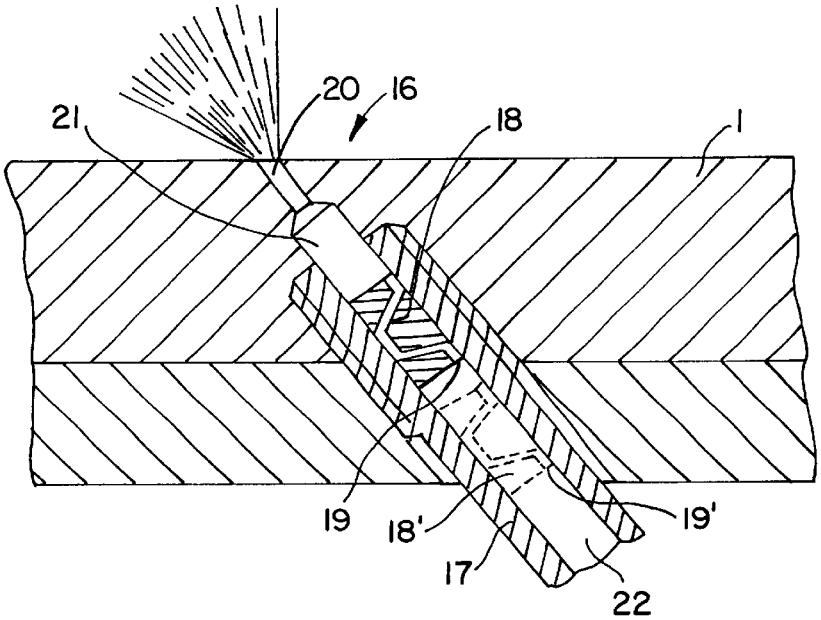
FIG. 2 shows a nozzle of the device represented in FIG. 1 in an enlarged scale.

A gun barrel of an automatic cannon, for example a gun barrel known from the prospectus OC 2059 3 94 of the Oerlikon-Contraves company of Zürich, Switzerland, is identified by 1 in FIGS. 1 and 2, which has a muzzle brake 3 at its front 2 and on whose back end 4 a revolving housing 5 with a revolving drum, not shown in greater detail, is arranged. A reservoir 6, which contains a coolant 7 being used as a lubricant for the gun barrel 1 at the same time, is connected via a line 8 and a flap valve 9 with a pressure cylinder 10. A piston 11, which is fixedly connected with a hydraulic piston 13 guided in a hydraulic cylinder 12, is guided in the pressure cylinder 10. The pressure cylinder 10 is connected via a feed line 14 and a valve 15 which, for example, can be electrically controlled, with the gun barrel 1. A nozzle 16, which has a sleeve 17 connected with the feed line 14 and is fixed in place on the gun barrel 1, is provided at the termination of the feed line 14 located at the back end 4 of the gun barrel 1. A labyrinth 18, or respectively 18', in the form of one or several insertion pieces is arranged in the sleeve 17, in which a labyrinth- or meander-like conduit 19, or respectively 19', for example, is provided which, as will be explained later, causes a pressure reduction. Alternatively, instead of labyrinth insertion pieces, a similar effect can be obtained by arranging a diaphragm in the path of the coolant. A nozzle bore in the gun barrel 1 is identified by 20 which, in the present case, is arranged concentrically in respect to the sleeve 17 and whose diameter is less than that of the feed bores 21, 22 provided in the gun barrel 1, or respectively in the sleeve 17.

The above described device functions as follows: By drawing up the hydraulic piston 13, the coolant 7 is conveyed from the reservoir 6 via the line 8 and the flap valve 9 into the pressure cylinder 10, while the electrically actuated valve 15 in the feed line 14 is closed. Thereafter, the hydraulic piston 13, and with it also the piston 11, is moved in the opposite direction by a pressure reversal in the hydraulic cylinder 12, and the coolant 7 in the pressure cylinder 10 is placed under a defined operating pressure of, for example, approximately 500 bar, so that the device is ready for use. Prior to triggering a volley, the valve 15 is opened, so that the coolant 7 can flow to the gun barrel 1 via the feed line 14 and the nozzle(s) 16. The high gas pressure of, for example, approximately 5000 bar being created in the course of subsequent firing pushes the coolant back, wherein the gas pressure is reduced by friction in the nozzle 16 to the operating pressure of approximately 500 bar and only little coolant flows back. As soon as the gas pressure in the gun barrel 1 has been reduced, the coolant 7 is continuously injected into the gun barrel 1 by the operating pressure until a further shot is fired. The valve 15 is closed again at the end of a series of firings.

Figure 3:
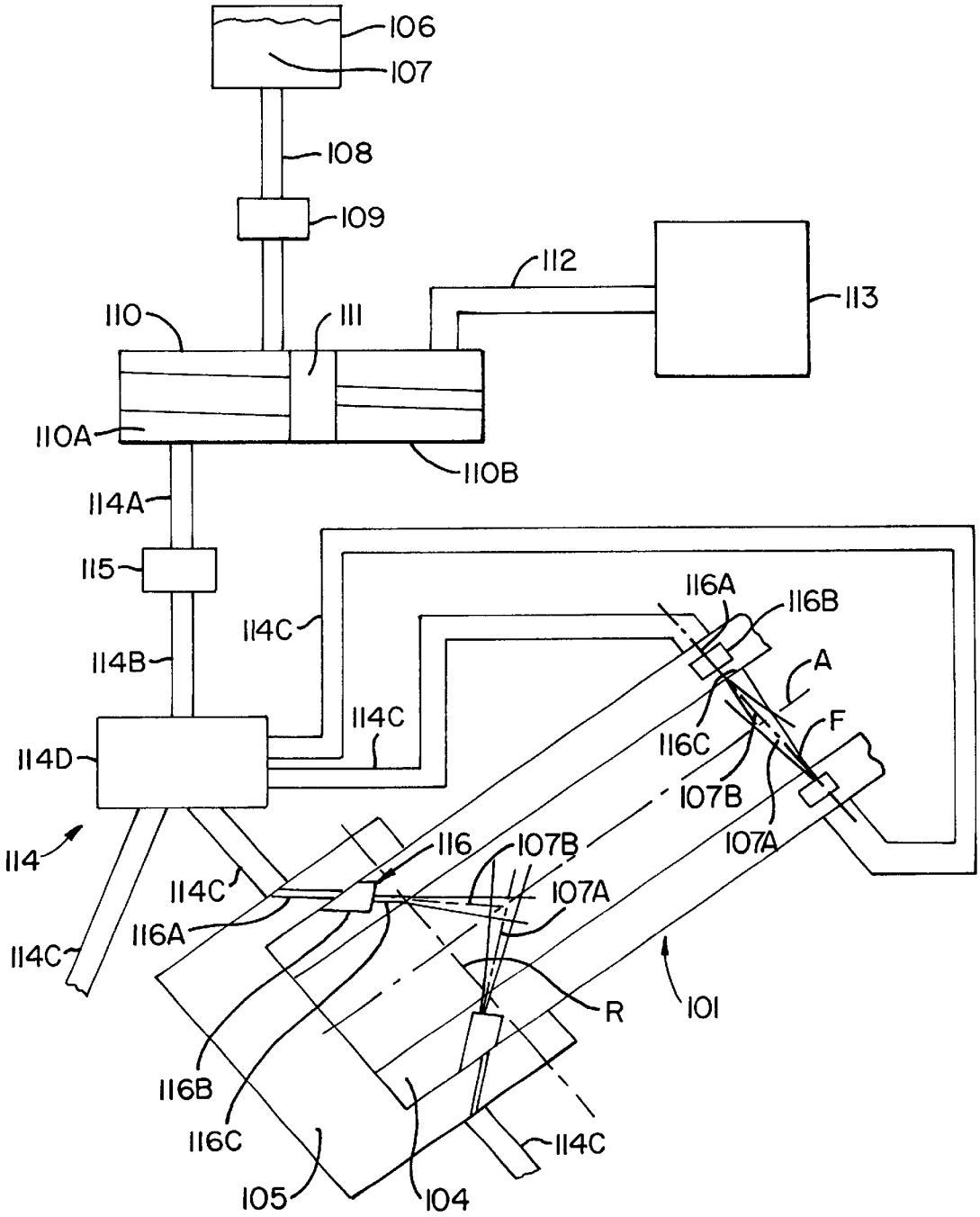
FIG. 3 shows a partial longitudinal section of a cannon with a second embodiment in accordance with the invention.

FIG. 3 is a schematic drawing which shows a gun barrel 101 with a barrel axis A. The end portion 104 of the barrel 101 is arranged in a housing 105, not shown in greater detail. The firearm is, only as an example, a cannon as known from the prospectus OC 2059 3 94 of the Oerlikon-Contraves company of Zürich, Switzerland.

A reservoir 106 containing a coolant 107 is connected via a line 108 in which a flap valve 109 is arranged with a first chamber 110A of a pressure cylinder 110 of a cylinder/piston device. A second chamber 110B of the pressure cylinder 110 is separated from the first chamber 110A by a piston 111 having different pressure surfaces in the first and second chambers. The cylinder/piston device comprising the pressure cylinder 110 and the piston 111 serves as a media exchanger of pressure fluids and as a pressure transducer. Chamber 110A contains the coolant which fed to the gun barrel 101 under an operating pressure; chamber 110B contains a pressure fluid and is connected via a line 112 with a pressure system 113 which generates a system pressure which may also be used for other purposes than for cooling the barrel 101.

The coolant is a liquid with, preferably, a high cooling capacity which is heated up while cooling the barrel. A very high cooling capacity is obtained when using a coolant which evaporates during cooling the barrel 101; it is however important to chose a coolant which, when evaporating, does not deteriorate in a way which could harm the surface of the barrel. A preferred coolant is water, to which a lubricant like e.g. graphite powder, is added.

The pressure fluid is a liquid, preferably an oil, which is suitable to be used in a pressure system of the firearm; the pressure fluid may be a liquid which is not suitable to be used as a lubricant or as a coolant. The pressure fluid is brought to a system pressure which may be higher or lower than the operating pressure of the coolant.

By using as a cylinder/piston device a media exchanger and pressure transducer, it is possible to chose on the one hand the most appropriate coolant and operating pressure and on the other hand the most appropriate pressure fluid and system pressure.

Chamber 110A of the pressure cylinder 110 is connected with the interior of the gun barrel 101, whereto the coolant 107 has to be fed. The coolant 107 from chamber 110A flows through a first feed line portion 114A of a feed line arrangement 114, a valve 115, which, for example, can be electrically controlled, a second feed line portion 114B of the feed line arrangement 114, a distributor 114D where the second feed line portion 114B is split in at least two partial feed lines, in the present embodiment into four partial feed lines 114C; the partial feed lines 114C are connected to end portions 116. Two partial feed lines 114C end at the outer surface of the housing 105, and the end portions 116 traverse the housing 105 and a rear portion 104 of the barrel 101. Two further partial feed lines 114C shown in dotted lines end directly at the barrel 101, i.e. in a portion of the barrel 101 which is not situated in a housing.

Each partial feed line 114C is connected with a diaphragm 116A, which may simply be a smaller diameter boring, near the feed line end portion 116. Each diaphragm 116A ends in a buffer reservoir 116B of the end portion 116. A nozzle 116C finally connects each buffer reservoir 116B with the inside of the barrel 101.

While the cross sections of the partial feed lines 114C and of the feed line portions 114A and 114B are so large that variations of the pressure therein may be neglected, the cross section of the diaphragm 116A and the cross section of the nozzle 116C are considerably smaller than the cross section of the partial feed lines 114C and of the feed line portions 114A.

The embodiment of FIG. 3 has two partial feed lines 114C with end portions 116 at a rearward section of the gun barrel 101 and two partial feed lines 114C with end portions 116 at a frontward section of the gun barrel 101. The coolant 107 therefore is fed to two gun barrel sections. In each of these sections of the barrel 101, the nozzles 116C are facing each other so that streams 107A, 107B are ejected from opposite nozzles 116C and meet in a central area of the barrel 101 with the intention of creating a mist of small quantities of coolant and achieving the same cooling effect around the barrel 101. This effect can be enhanced by arranging one or more additional end portions in mutual angular distances around the barrel in the same cross section, each of these end portions 116 being connected to a partial feed line 114C.

In the embodiment of FIG. 3, the end portions 116 in cross section F being connected with the feed lines 114C ending at the gun barrel are arranged with their axes at 90° with respect to the axis of the barrel 101, so that the coolant is ejected in radial direction. The end portions 116 in cross section R connected with partial feed lines 114C ending at the housing 105 are arranged with their axes at an angle of less than 90° with respect to the axis of the barrel 101, such as the approximately 45 degree angle shown, so that the coolant is ejected in a forward direction. Although this non-perpendicular arrangement is more difficult to make, it is chosen in order to prevent the coolant from immersing the rear portions of the fire arm. End portions, especially when they are arranged at the foremost end of the gun barrel, may also be arranged to eject the coolant rearwardly.

The arrangement of the feed lines, pressure cylinder and branching may be different in detail than what has been described above, but the basic concept is that coolant under operating pressure is fed to the barrel chamber through an end portion, preferably with a diaphragm, a buffer reservoir and a nozzle prior to and during firing a round, and that the coolant is pushed back between the shots of a round.

The above described device as depicted in FIG. 3 functions as follows: Chamber 110B is de-pressurized. The coolant 107 is conveyed from the reservoir 106 via the line 108 and the flap valve 109 into the chamber 110A of the pressure cylinder 110, while the electrically actuated valve 115 in the feed line portion 114A is closed. Thereafter, the chamber 110B is pressurized, and the coolant 107 in the chamber 110A is placed under the defined operating pressure of, for example, approximately 500 bar, so that the device is ready for use. Prior to triggering a series of firings, the valve 115 is opened, so that the coolant 107 can flow to the gun barrel 101. The high gas pressure in the barrel 101 of, for example, approximately 5000 bar is created in the course of subsequent firing which pushes the coolant back, wherein the gas pressure is reduced by friction to the operating pressure of approximately 500 bar and only little coolant 107 flows back. As soon as the gas pressure in the gun barrel 101 has been reduced, the coolant 107 is again continuously injected into the gun barrel 101 by the operating pressure until a further shot is fired. The valve 115 is closed only at the end of a firing.

What is claimed is:

1. A method for cooling a gun barrel of a firearm comprising the steps of:

conveying coolant from a reservoir into a pressure cylinder by drawing up a hydraulic piston, while a pressure feed line between the pressure cylinder and a nozzle is closed, thereafter moving the hydraulic piston in the opposite direction by a pressure reversal, so that the coolant in the pressure cylinder is placed under a predefined operating pressure which is higher than the ambient pressure, opening said pressure feed line to said nozzle before firing a round, so that the coolant flows to the gun barrel via said pressure feed line and nozzle, allowing the coolant pressure in said gun barrel to be compressed to a pressure above said predefined operating pressure and pushed out of the gun barrel by the gas pressure in the barrel chamber built up when firing a shot, expanding the coolant in a buffer reservoir adjacent the nozzle to said predefined operating pressure, and injecting the coolant back into the gun barrel after the gas pressure built up by firing the shot has been reduced to below said predefined operating pressure.

2. A method in accordance with claim 1, wherein the coolant is evaporated while cooling the gun barrel.

3. A device for cooling a gun barrel comprising a reservoir which stores coolant fluid, a pressure cylinder connected to said reservoir having a first chamber and a second chamber, wherein said second chamber is connected to a pressure system containing a pressure fluid and is adapted to generate a predefined system pressure on said first chamber through a pressure piston, a feed line including an upstream portion connecting said first pressure cylinder chamber to said reservoir and a downstream portion connecting said first pressure cylinder chamber to said gun barrel, a downstream feed line end connected to said gun barrel for said downstream feed line having a diaphragm, a buffer reservoir and a nozzle wherein said coolant fluid can flow into said gun barrel whenever the pressure in said gun barrel is lower than said predefined pressure, including before a round is fired.

4. A device in accordance with claim 3, wherein said coolant is a liquid to which a lubricant is added and which has an evaporation temperature that is lower than the firing temperature of the gun barrel so that the liquid evaporates while cooling the gun barrel.

5. A device in accordance with claim 3, wherein the pressure fluid is an oil.

6. A device in accordance with claim 3, wherein the gun barrel is cylindrical in shape and the axis of the nozzle is arranged at an angle of 90° with respect to the axis of the gun barrel so as to eject coolant in a radial direction into the gun barrel.

7. A device in accordance with claim 3, wherein the gun barrel is cylindrical in shape and the axis of the nozzle is arranged at an angle of less than 90° with respect to the axis of the gun barrel chamber so as to eject the coolant both in a radial and in a forward or backward direction into the gun barrel.

8. A device in accordance with claim 3, further comprising a feed line distributor wherein the downstream feed line portion is split into at least two partial feed lines, each of said partial feed lines being connected to the gun barrel chamber via a separate end portion having a diaphragm, a buffer reservoir and a nozzle.

9. A device in accordance with claim 8, wherein at least two of said partial feed lines are connected with nozzles arranged facing each other in essentially the same section of the barrel and adapted to eject coolant in two separate coolant streams so that said streams mix in the area of the axis of the gun barrel.

10. A device in accordance with claim 8, wherein at least two of said partial feed lines are connected with nozzles arranged in sections of the barrel which are axially spaced apart and adapted to eject coolant into rearward or frontward portions of the gun barrel.

* * * * *